United States Patent [19]

Hicks

[11] Patent Number: 4,628,780

[45] Date of Patent: Dec. 16, 1986

[54] AIR EJECTOR SYSTEM

[75] Inventor: Charles D. Hicks, Warren, Mich.

[73] Assignee: Rochez Bros., Inc., Warren, Mich.

[21] Appl. No.: 733,039

[22] Filed: May 13, 1985

[51] Int. Cl.[4] ..... B26F 1/14

[52] U.S. Cl. ..... 83/99; 83/98; 83/685; 83/621

[58] Field of Search ..... 83/98–100, 83/124, 621, 125, 686–691

[56] References Cited

U.S. PATENT DOCUMENTS

| | | | |
|---|---|---|---|
| 2,313,525 | 3/1943 | Edelman | 83/98 |
| 2,487,271 | 11/1949 | Petri | 83/98 |
| 3,236,130 | 2/1966 | Robert | 83/98 |
| 3,550,491 | 12/1970 | Wingard | 83/99 X |
| 3,771,396 | 11/1973 | Im | 83/98 |
| 3,939,743 | 2/1976 | Coombes | 83/98 |

*Primary Examiner*—James M. Meister
*Assistant Examiner*—John L. Knoble
*Attorney, Agent, or Firm*—Irvin L. Groh

[57] ABSTRACT

An air ejector system for use in a horizontal or vertical stamping press which reciprocates the moving member of a die set to produce an annular product. Air is introduced through a central punch for shedding and ejecting a slug. Air is also introduced through an annular knockout for shedding and ejecting a coaxially produced product. A resilient member retains the knockout in a position rearwardly of the punch and button die during the forward punching stroke. Valving sequentially introduces the air through the punch and knockout at the appropriate points in the reciprocating stamping cycle.

5 Claims, 4 Drawing Figures

4
4

AIR EJECTOR SYSTEM

This invention relates to stamping presses and more particularly to an air ejection system for use in the reciprocating assembly of a stamping press for inducing disengagement of a central slug member and a coaxially stamped product from the die members. The construction of a universal die set for operation in a vertical stamping press is described in U.S. Pat. No. 2,699,830 to Hugh M. Hodge. The Hodge patent shows an upper reciprocable die holding shoe and a lower fixed die holding shoe which together hold a plurality of exchangeable cooperating die elements. Typically, the upper shoe holds a punch and a button die which cooperates with a compound blank punch and pierce die mounted on the stationary lower shoe to produce stamping. A knockout located in the space between the button die and the punch in the upper reciprocating shoe serves to push the completed stamping away from the punch and button die by relative motion with respect thereto. The problems associated with the design of the die components are addressed in detail in a special report in "American Machinists/Metalworking Manufacturing", May 28, 1962 issue, pages 103–118.

Similarly, the design of a horizontal press and a universal die component is described in U.S. Pat. No. 3,213,729 to Richard C. Koch. Like the die components for the vertical press, a knockout located in the space between a button die and punch serves to push the completed stamping away from the punch and button die.

While the knockout serves to push the completed stamping away from the forming die and punch on the moving press member and a stripper plate associated with the opposed compound die on the stationary press member separate the stock material from the compound die, problems are still encountered in removing the central slug from the punch and the finished part from the knockout. Typically, the solution to this problem has been attempted by using spring pins in the punch and knockout members and air nozzles to blow air across the knockout face to assist in part ejection. In slower operations, this has proved satisfactory, but at higher speeds the finished part has a tendency to hang upon the protruding spring pins on both the knockout and punch and the central slug does not remain in the central aperature of the compound die for disposal therethrough.

It is therefore a primary object of this invention to provide means for ejecting or shedding the central slug and annular product stamping from the punch and knockout in a reliable manner to permit its use on high speed vertical and horizontal stamping presses.

It is another object of this invention to provide means for shedding the central slug and finished part without introducing elements which induce finished part hangup or buildup of central slugs which cannot be moved by the ejector.

It is still a further object of this invention to provide an ejector which can be used with parts being formed from soft material which would be damaged or pierced by the prior art spring pin device.

Another object of this invention is to provide means for ejecting thin section parts in which the space limitations prevent the use of such devices as spring pins.

The foregoing objects of this invention have been met with the elimination of spring pin ejectors and the like.

The heretofore seemingly impractical use of air jets issuing from nozzles from shedding the part and slug has been accomplished by introduction of air ejectors in the moving punch and knockout components.

The air ejector system is built into the reciprocating assembly of the stamping press to be used independently or in cooperation with a conventional air blowoff nozzle which provides an air blast across the die face. The air injection is provided during reciprocation of the assembly in the forward working direction and the rearward retraction direction.

The reciprocating assembly has a moving carrier or ram having a recess at its forward end. A button die is removably mounted in the recess, and a punch is removably mounted in the recess within the button die in axial alignment with cooperating stationary die members. The punch has a cutting surface at its forward end and a cylindrical body portion extending rearwardly from the button die.

An axial air ejector passage extends from within the body portion to the cutting surface of the punch. A generally radial passage connects to the axial air ejector passage extending outwardly to the exterior of the cylindrical body portion of the punch. A punch retainer is mounted in the recess rearward of the button die having a bore in which the cylindrical body portion of the punch is located. A backing plate is mounted in the recess in contact with the rearward end of the punch retainer. An annular air passage is contiguous to the retainer bore and located in either the punch body portion or the punch retainer in communication with the radial passage in the punch. Preferably, the annular air passage is located in the punch retainer so that various sized punches with a uniform body portion may be accommodated in a single punch retainer. A first supply conduit connects the annular air passage to a supply of compressed air external of the reciprocating assembly.

A stamped product knockout surrounds the punch in the space between the punch and the button die. The knockout is axially slidable relative to the punch and button die between a forward position in which its front end projects forwardly beyond the front ends of the punch and the button die and in a rearward position, in which its forward end is withdrawn rearwardly of the front ends of the punch and button die. The knockout has an axial air ejector passage extending therethrough in fluid communication with a cavity between the rearward end of the knockout and the forward end of the punch retainer. The cavity is bounded peripherally by the button die as it abuts against the punch retainer. A second supply conduit connects with an axially extending air passage means through the punch retainer and the backing plate and a supply of compressed air external of the reciprocating assembly.

As the assembly moves forward to punch and blank the stamped product, air is passed through the axial punch ejector passage to shed the slug from the punch cutting surface and push it into an exit passage in the stationary die. As the assembly retracts rearwardly, the air passing through the axial air ejector passage in the punch will retain the slug in the exit passage of the die. When the reciprocating assembly has retracted rearwardly to the end of its stroke and the knockout projects forwardly beyond the front ends of the punch and button die, air passing through the axial air ejector passage in the knockout will shed the stamped product from the front end of the knockout.

The knockout has an outwardly extending flange at its rearward end and the button die has a rearward cavity portion which accommodates the knockout flange. A resilient member is fitted over the forward end of the knockout and acts between the knockout flange and the button die to provide a seal between the two to maintain the air retention integrity of the cavity between the rearward end of the knockout and the forward end of the punch retainer. The resilient member also acts as an axial positioner to retain the front end of the knockout rearwardly of the front ends of the punch and button die unit it is compressed at the rearward end of the retraction stroke.

Where the stamping press is a vertical stamping press, the carrier includes an upper shoe containing a portion of the recess and an annular die retainer mounted on the face of the shoe containing a portion of the recess. The button die is located in the portion of the recess within the die retainer, and the punch retainer extends into the portion of the recess contained in the shoe.

Air can flow continuously through the axial air ejector passage in the punch; however, in the preferred embodiment, a three way valve is located in the supply conduit furnishing air to the annular air passage in the punch retainer. The valve supplies air to the annular air passage during the forward stroke of the reciprocating assembly and is closed to the annular air passage during the retraction stroke of the assembly. This provides for shedding of the slug as it is punched from supply sheet and for pushing it into and retaining it in the exit passage of the stationary die as the punch retracts.

The three way valve also supplies air to the axial knockout air ejector passage at the rear end of the retraction stroke as the knockout slides forward of the punch and button die in order to shed the stamped product from the front end of the knockout.

The preferred embodiment of the invention is illustrated in the drawing in which.

Figure 1:
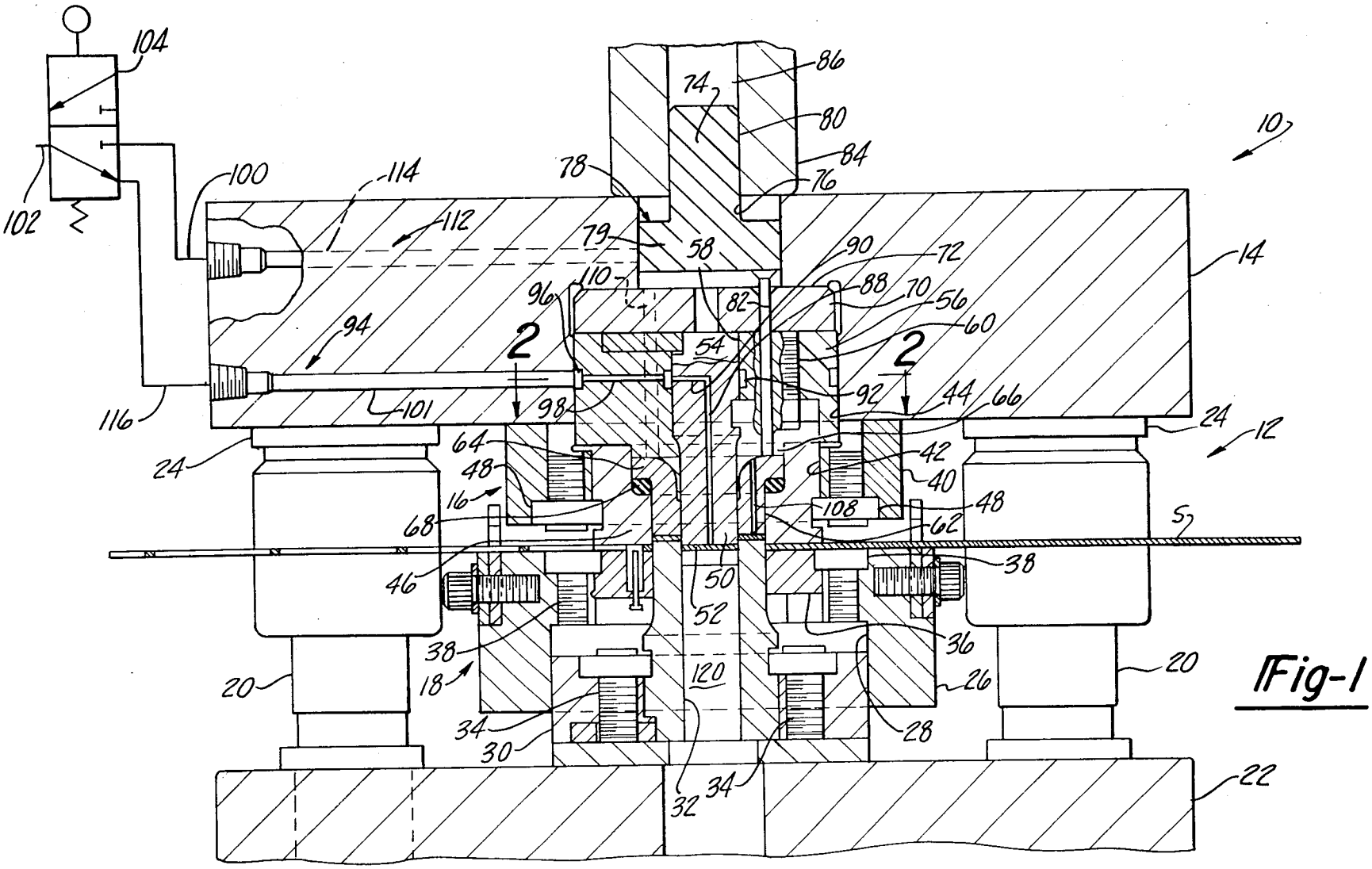
FIG. 1 is an elevational view in section showing the air ejector system of the invention applied in cooperation with a die set in a vertical press in which it has been installed.

Referring to FIG. 1, vertical stamping press 10 has die set 12 fixed in an operating position in which the upper shoe 14 contains upper die assembly 16 which is maintained in aligned position with the lower die assembly 18 by pins 20 affixed to lower shoe 22 and slidably received in bearings 24 attached to upper shoe 14.

Associated with the lower shoe 22 is stripper block 26 which has a cylindrical recess 28 which houses compound die retainer 30. Stripper block 26 is held by bolts (not shown) to lower shoe 22 for limited vertical motion relative thereto. The stripper block is normally held in a raised position by a plurality of springs (not shown) acting between recesses in the stripper block 26 and the lower shoe 22. A compound blank punch and pierce die 32 is held in compound die retainer 30 by lock screws 34. The upper portion of compound die 32 is surrounded by stripper insert 36 which is held in stripper block 26 by lock screws 38.

Annular die retainer 40 is mounted on the lower face of upper shoe 14 by screws and alignment pins (not shown). The central aperture 42 of die retainer 40 is aligned with compound die 32 and recess 44 in upper shoe 14. Button die 46 is removably mounted in central aperture 42 of die retainer 40 by a lock screws 48.

Punch 50 is removably mounted in recess 44 within button die 46 in axial alignment with stationary compound die 32. Punch 50 has a cutting edge 52 at its lower end and a cylindrical body portion 54 extending upwardly above button die 46. Punch retainer 56 is mounted in recess 44 above button die 46 having a bore 58 in which the cylindrical body portion 54 of punch 50 is located. Punch 50 is held in punch retainer 56 by lock screw 60 which engages a slot in the cylindrical body portion 54.

A stamped product knockout 62 surrounds punch 50 in the space between punch 50 and button die 46. Knockout 62 has an outwardly extending flange 64 at its upper end which is accommodated with a sliding fit in an upwardly extending cavity portion 66 of button die 46. A resilient member 68 is fitted over the lower end of knockout 62 so that it acts between flange 64 and button die 46 to retain knockout 62 in a normal position above the lower face of button die 46 and cutting edge 52 of punch 50. Backing plate 70 is mounted in recess 44 in contact with the upper surface of punch retainer 56. Upper wall 72 defines the upper end of the main body of recess 44 and acts to retain backing plate 70 from upward movement.

Spider element 74 is mounted in the reduced area portion 76 of recess 44 above upper wall 72 and backing plate 70. Spider 74 has a radially extending contact portion 78 at its lower end usually in the form of a plurality of radially extending arms 79 and a shank portion 80 extending axially from the top of the upper shoe 14.

A plurality of knockout pins 82 extend through holes in punch retainer 56 and backing plate 70 with the upper ends of each pin in contact with a radially extending contact portion 78 of spider element 74. The lower end of each pin is in contact with the top of flange 64 on knockout 62.

Figure 3:
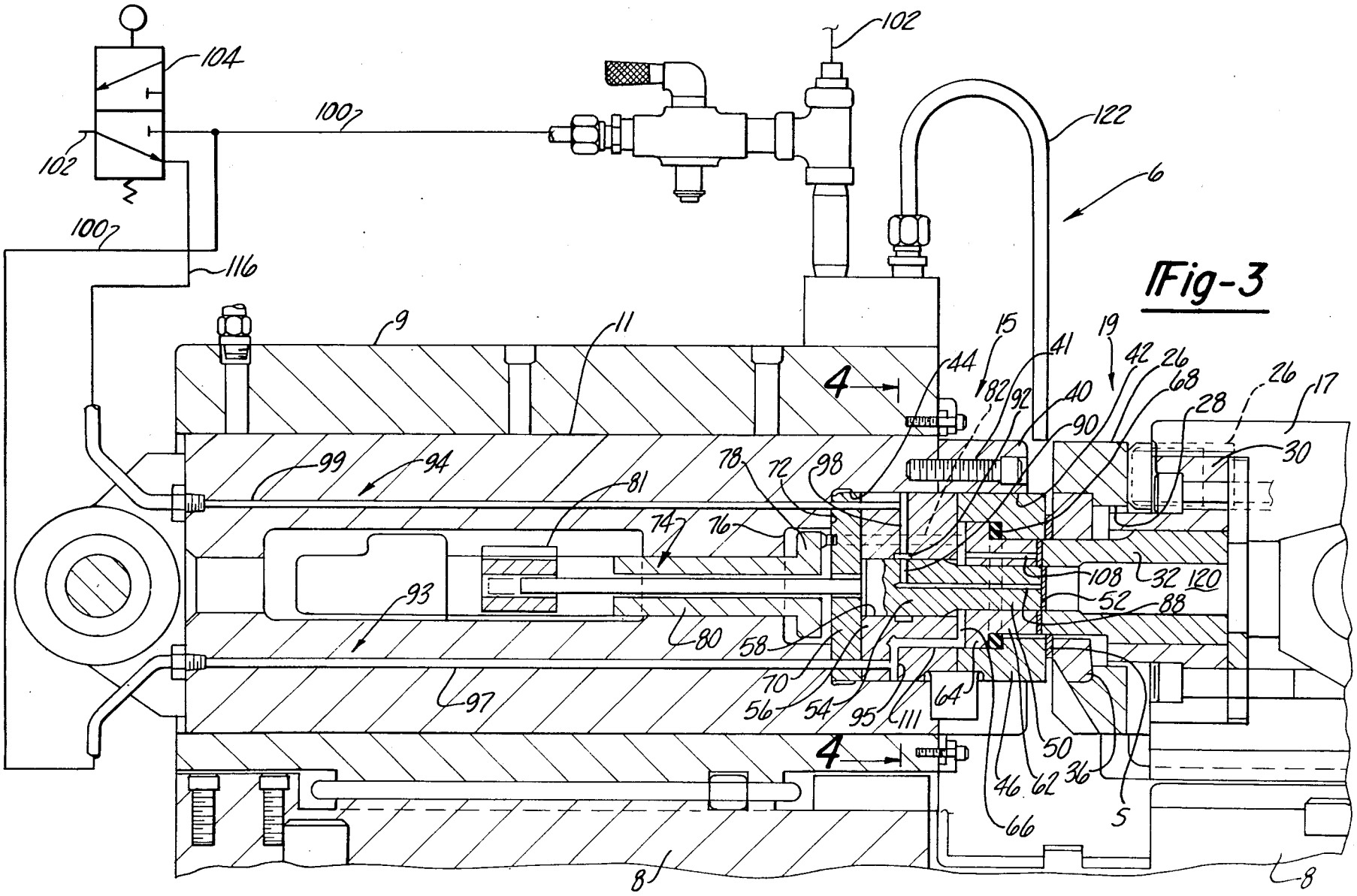
FIG. 3 is a sectional view showing the air ejector system of the invention as applied to the die components of a horizontal press.

In smaller sized die sets, and those used in horizontal presses, as that shown in FIG. 3, the radially extending contact portion 78 of spider element 74 is in the form of an annular flange.

Extending above the upper shoe 14 is bushing 84 containing the upper end of spider shank 80. Also extending into the top of busing 84 is knockout bar 86 which during the upward stroke of the press hits a stop bar contacting stationary stop elements on the press (not shown) in order to induce the relative motion of knockout 62 with respect to punch 50 and button die 46 through knockout pins 82 and spider element 74. The further functions of bearing 84 and its relationship to the die components are set forth in my copending patent application Ser. No. 733,033, filed on May 13, 1985 contemporaneously with this application.

Figure 2:
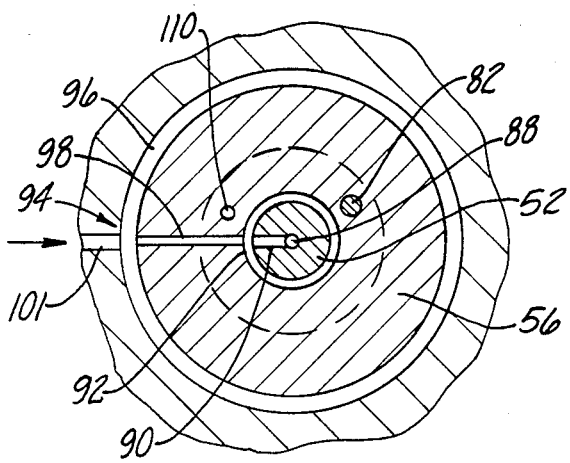
FIG. 2 is a sectional view taken along line 2—2 of FIG. 1 showing the air ejector system of the invention supplying the punch ejector air through annular passages in the punch retainer.
Figure 4:
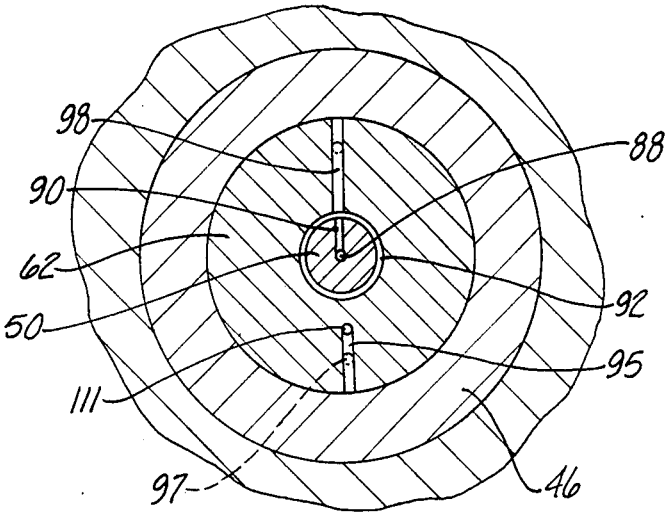
FIG. 4 is a sectional view along line 4—4 of FIG. 3 showing the air supply to the axial punch ejector passage.

Punch 50 has an axial air ejector passage 88 extending upwardly from cutting edge 52 to a point with cylindrical body portion 54. Radial air passage 90 connects axial air ejection passage 88 to the periphery of cylindrical body portion 54 where it communicates with annular passage 92. Annular passage 92 can be in either the punch cylindrical body portion 54 or extend into punch retainer 56 from bore 58. Preferably, annular passage 92 is formed in the punch retainer so that the same retainer can be used with a number different sized punches 50 having a common diameter for cylindrical body portion 54. A supply conduit 94 connects the annular passage 92 to a supply of compressed air external reciprocating shoe 14. As shown in FIGS. 1 and 2, air supply conduit 94 includes an annular passage 96 in the periphery of punch retainer 56 and a radial passage 98 connecting annular passages 92 and 96. Supply conduit 94 also includes radial passage 101 connected to annular passage 96 and to a flexible line 116 shown schematically connected to spring loaded, cam actuated three-way valve 104 which opens or closes the air flow from air supply line 102 through line 116 responsive to the position of upper shoe 14.

Axial air injector passage 108 extends through knockout 62 from its lower end and out of its upper end through flange 64 into the cavity 66 formed between the upper end of knockout 62 and the lower end of punch retainer 56. The cavity 66 being bound peripherally by button die 46 as it abuts against punch retainer 56 and having an additional sealing means in the form of resilient member 68. Air is introduced into the cavity 66 by axially extending passage 110 extending upwardly through punch retainer 56 and backing plate 70 into shoe 14. A supply conduit 112 connects the upper end of passage 110 to a supply of compressed air external to reciprocating shoe 14. As shown in FIGS. 1 and 2, supply conduit 112 includes horizontal passage 114 in shoe 14 and flexible line 100. Flexible line 100 is connected to the spring loaded, cam actuated three-way valve 104 to permit air flow from air supply line 102 through line 100 responsive to the position of upper shoe 14.

In operation, as upper die assembly 16 is reciprocated in a stamping cycle, punch 50 and button die 46 are brought into contact with strip stock S, punch 50 entering the central cavity 120 of compound blank punch and pierce die 32 while button die 46 contacts work strip S moving downwardly against stripper insert 36 to depress stripper block 26 to punch out a central slug and a surrounding stamped product from the strip. During this stamping downstroke knockout 62 is maintained in the position as shown in FIG. 1 where its lower end is withdrawn upwardly of the cutting edge 52 of punch 50 and lower end of button die 46 by resilient member 68. During this stamping downstroke, air flows from air supply line 102 through three-way valve 104 and supply conduit 94 including flexible conduit 116, radial passage 101, annular passage 96, radial passage 98, annular passage 92 into radial punch passage 90 and through the axial air ejector passage 88 in punch 50 to shed the central slug from the end of the punch 50 as it enters compound die 32. The air stream continues during the initial part of the upstroke, or retraction stroke, to maintain the slug within passage 120.

At the top of the retraction stroke, the knockout bar 86 hits a fixed stop on the press to be thrust downward against spider element 74 pushing knockout pins 82 against knockout flange 64 advancing the front face of knockout 62 so that it extends downwardly to a position in which its lower end extends beyond the cutting edge 52 of punch 50 and the lower end of button die 46. This separates the stamped product from the punch 50 and button die 46, but the stamped product normally remains sticking to the face of the knockout, for example by the adhering forces created by the oil on strip S. However, air passing from air supply line 102 through three way valve 104 and through supply conduit 112, including flexible conduit 100 and radial passage 114, and axially extending passage 110 into cavity 66, and into the axial air ejector passage 108 in knockout 62 sheds the stamped product from the face of the knockout. The supply of air through the knockout ejector passage can be synchronized with the movement of the knockout by actuation of three way valve 104 at the upper end of the retraction stroke supplying the air from air supply 102.

Referring to FIG. 3, a horizontal high speed punch press 6 is shown embodying the air ejector system of the invention. The same numerals have been used to designate corresponding parts on this horizontal press functioning in the same manner as the vertical press of FIG. 1. Horizontal press 6 includes a stationary frame 8 having cylinder 9 mounted thereon slidably supporting carrier or piston 11 for forward stamping movement to the right and rearward retraction movement to the left, as viewed in FIG. 3. Upright stationary rear support 17 mounts the stationary die component assembly 19. Stationary assembly 19 includes stripper block 26 having cylindrical recess 28 housing compound die retainer 30. Stripper block 26 is held by bolts (not shown) to vertical support 17 for limited horizontal movement relative thereto. The stripper block is normally held in a forward position by a plurality of springs (not shown) acting between recesses in the stripper block 26 and support 17. A compound blank punch and pierce die 32 is held in compound die retainer 30 and extends through the stripper block 26. The forward portion of compound die 32 is surrounded by stripper insert 36.

Moving die assembly 15 includes annular die retainer 40 mounted on the forward face of carrier 11 by bolts 41. Central aperature 42 of die retainer 40 is aligned with compound die 32 and recess 44 in carrier 11. Annular button die 46 is mounted in central aperature 42 of die retainer 40. Punch 50 is mounted in recess 44 within button die 46 in axial alignment with stationary compound die 32. Punch 50 has a cutting edge 52 at its forward end and a cylindrical body portion 54 extending rearwardly of button die 46. Punch retainer 56 is mounted in recess 44 rearward of button die 46 having a bore 58 in which the cylindrical body portion 54 of punch 50 is located.

An annular stamped product knockout 62 surrounds punch 50 in the space between punch 50 and button die 46. Knockout 62 has an outwardly extending flange 64 at its rearward end which is accommodated with a sliding fit in a rearwardly extending cavity portion 66 of button die 46. A resilient member 62 is fitted over the forward of knockout 62 so that it acts between flange 64 and button die 46 to retain the knockout in a normal position rearward of the forward face of the button die 46 and the cutting edge 52 of punch 50.

Backing plate 70 is mounted in recess 44 in contact with the rearward surface of punch retainer 56. Rear wall 72 defines the rear end of the main body of recess 44 and acts to retain backing plate 70 from rearward movement.

Spider element 74 is mounted in the reduced area portion 76 of recess 44 rearward of wall 72 and backing plate 70. Spider element 74 has a radially extending contact portion of flange 78 at its forward end and a shank portion 80 extending rearwardly in carrier 11.

A plurality of knockout pins 82 extend through holes in punch retainer 56 and backing plate 70 with the rearward end of each pin in contact with flange 78 of spider element 74. The forward end of each pin is in contact with the rear edge of flange 64 of knockout 62.

During the return stroke of carrier 11, shank 80 of spider 74 will contact adjustable stop 81, thus moving knockout 62 forward through knockout pins 82 so that its forward face extends beyond the cutting edge 52 of punch 50 in the forward face of button die 46.

Punch 50 has axial air ejector passage 88 extending forwardly from a point within cylindrical body portion 54 to cutting edge 52. Radial air passage 90 connects axial air ejector passage 88 to the periphery of cylindrical body portion 54 where it communicates with an annular passage 92. As in the vertical press, annular passage 92 is preferably formed in the punch retainer so that the same retainer can be used with a number of different sized punches 50 having a common diameter for cylindrical body portion 54. A supply conduit 94 connects the annular passage 92 to a supply of compressed air external of reciprocating carrier 11. As shown in FIG. 3, air passage 94 includes passage 98 extending radially outward in punch retainer 56 from annular passage 92. Supply conduit 94 also includes axial passage 99 connected at the forward end to radial passage 98 and extending rearwardly through punch retainer 56, backing plate 70 and carrier body 11 to flexible line 116 shown schematically connected to air supply line 102 through three-way valve 104.

Axial air injector passage 108 extends through knockout 62 from its forward end out its rearward end through flange 64 into cavity 66 formed between the rearward end of knockout 62 and the forward end of punch retainer 56. This cavity is bounded peripherally by button die 46 as it abuts against punch retainer 56, and an additional seal is provided by resilient member 68. Air is introduced into the cavity 66 by axial extending passage 111 in retainer 56. The supply conduit 93 connects axial passage 111 to a supply of compressed air external of reciprocating carrier 11. As shown in FIG. 3, air supply conduit 93 includes radial air passage 95 in punch retainer 56 and axially extending air passage 97 in carrier 11. Supply conduit 93 also includes flexible line 100 shown schematically connected to air supply line 102 through three-way valve 104.

In operation, as carrier 11 is reciprocated in a stamping cycle, punch 50 and button die 46 are brought into contact with strip stock S, punch 50 entering the central cavity 120 of compound blank punch and pierce die 32 while button die contacts work strip S moving forwardly against stripper insert 36 to depress stripper block 26 to punch out a central slug and surrounding stamped product from the strip. During this stamping forward stroke, knockout 62 is maintained in the position as shown in FIG. 3 where its forward end is withdrawn rearwardly of the cutting edge 52 of punch 50 and the forward face of button die 46 by resilient member 68. Also during this forward stamping stroke, air flows from air supply line 102 through three-way valve 104 and supply conduit 94 including flexible line 116, axial passage 99, radial passage 98, annular passage 92 and radial passage 90 to and through the axial air ejector passage 88 in punch 50 to shed the central slug from the end of punch 50 as it enters compound die 32. The air stream continues during the initial part of the rearward retraction stroke to maintain the slug within passage 120.

At the end of the retraction stroke, shank 80 of spider element 74 hits stop 81 to be thrust forward pushing knockout pins 82 against the knockout flange 64 which advances the front face of knockout 62 so that it extends forwardly to a position in which its forward end extends beyond the cutting edge 52 of punch 50 and the forward face of button die 46. This separates the annular stamped product from the punch 50 and button die 46, but the product remains adhering to the face of the knockout. Air passing from air supply line 102, through three-way valve 104 and supply conduit 93 and out through axially extending ejector passage 108 in knockout 62 sheds the stamped product from the face of the knockout. The supply of air through knockout ejector passage can be synchronized with the movement of the knockout by actuation of three-way valve 104 at the end of the retraction stroke supplying air from air supply 102.

In order to assist in conveying the stamped product, an additional air blow off jet 122 may be used to supply air across the face of the dies from air supply 102. Air jet 122 is controlled by air from three-way valve 104 at the same time air is being supplied through the knockout by flexible line 100. It will be readily apparent that the electrically operated solenoid valves and limit switches can be used to replace the cam operated air valve responsive to the position of the moving die assembly 15 or carrier 11.

The embodiments of the invention in which an exclusive property or privilege is claimed are defined as follows:

1. An air ejector system for use in the reciprocating assembly of a stamping press to induce disengagement of a central slug and a coaxial stamped product, said assembly being mounted relative to a stationary die member for movement in a forward working direction toward said stationary die to blank and punch said product and for movement in a rearward retraction direction away from said die comprising, in combination: a carrier; a recess in the forward end of said carrier; a button die removably mounted in said recess; a punch removably mounted in said recess within said button die in axial alignment with said stationary die member, said punch having a cutting surface at its forward end, a cylindrical body portion extending rearwardly from said button die, and an axial air ejector passage extending from within said body portion to said cutting surface, a generally radial passage connecting said axial ejector passage with the exterior of said cylindrical body portion; a punch retainer mounted in said recess rearward of said button die and having a bore in which the cylindrical body portion of said punch is located; a backing plate mounted in said recess in contact with the rearward end of said punch retainer; and annular air passage contiguous to said retainer bore located in one of said punch body portion and said punch retainer in fluid communication with said radial passage in said punch; a first supply conduit connecting said annular air passage to a supply of compressed air external of said reciprocating assembly; valve means in said first supply conduit, opening during the forward stroke of said assembly, remaining open through the initial part of said retraction stroke, and closing during the retraction stroke of said assembly; an annular stamped product knockout surrounding said punch in the space between said punch and said button die, said knockout being axially slidable relative to said punch and said button die between a forward position in which its front end projects forwardly beyond the front ends of said punch and said button die and a rearward position in which its forward end is withdrawn rearwardly of said front ends, said knockout having an axial air ejector passage extending through said knockout; axial air passage means extending through said backing plate and said punch retainer for introducing air into the cavity between the rearward end of said knockout and the forward end of said punch retainer and bounded peripherally by said button die as it abuts against said punch retainer; a second supply conduit connecting said axially extending air passage means in said backing plate to a supply of compressed air external of said reciprocating assembly whereby as said assembly moves forward to punch and blank said stamped product, air passing through said axial punch ejector passage will shed a slug from said punch cutting surface and push it into an exit passage in said stationary die, and, when said assembly retracts rewardly air will continue passing through said axial punch ejector passage during the initial part of said retraction stroke to retain said slug in said exit passage, and air passing through said axial air ejector passage in said knockout will shed said stamped product from the front end of said knockout.

2. The air ejector system of claim 1 wherein said annular air passage is formed in said punch retainer.

3. The air ejector system of claim 1 wherein said stamping press is a vertical stamping press and said carrier includes an upper shoe containing a portion of said recess and an annular die retainer mounted on the lower face of said shoe containing a portion of said recess, said button die being located in the portion of said recess within said die retainer, and said punch retainer extending into the portion of said recess contained in said shoe.

4. The air ejector system of claim 1 further comprising valve means in said second supply conduit opening at the end of said retraction stroke as said knockout slides into its forward position to shed said stamped product from the front end of said knockout.

5. An air ejector system for use in the reciprocating assembly of a stamping press to induce disengagement of a central slug and a coaxial stamped product, said assembly being mounted relative to a stationary die member for movement in a forward working direction toward said stationary die to blank and punch said product and for movement in a rearward retraction direction away from said die comprising, in combination: a carrier; a recess in the forward end of said carrier; a button die having a rearwardly extending cavity portion removably mounted in said recess; a punch removably mounted in said recess within said button die in axial alignment with said stationary die member, said punch having a cutting surface at its forward end, a cylindrical body portion extending rearwardly from said button die, and an axial air ejector passage extending from within said body portion to said cutting surface, a generally radial passage connecting said axial ejector passage with the exterior of said cylindrical body portion; a punch retainer mounted in said recess rearward of said button die and having a bore in which the cylindrical body portion of said punch is located, a backing plate mounted in said recess in contact with the rearward end of said punch retainer; an annular air passage contiguous to said retainer bore located in one of said punch body portion and said punch retainer in fluid communication with said radial passage in said punch; a first supply conduit connecting said annular air passage to a supply of compressed air external of said reciprocating assembly; an annular stamped product knockout having an outwardly extending flange at its rearward end located in the rearwardly extending cavity portion of said button die and a forward end surrounding and slidable relative to said punch in the space between said punch and said button die, a resilient member fitted over the forward end of said knockout acting as a seal between said knockout and button die and also acting as an axial positioner, being compressed in a forward position of said knockout in which its front end projects forwardly beyond the front ends of said punch and said button die and in a rearward position retaining said knockout with its forward end withdrawn rearwardly of said front ends, said knockout having an axial air ejector passage extending through said knockout; axial air passage means extending through said backing plate and said punch retainer for introducing air into the cavity between the rearward end of said knockout and the forward end of said punch retainer and bounded peripherally by said button die as it abuts against said punch retainer; a second supply conduit connecting said axially extending air passage means in said backing plate to a supply of compressed air external of said reciprocating assembly whereby as said assembly moves forward to punch and blank said stamped product, air passing through said axial punch ejector passage will shed a slug from said punch cutting surface and push it into an exit passage in said stationary die, and, when said assembly retracts rearwardly, air passing through said axial air ejector passage in said knockout will shed said stamped product from the front end of said knockout.

* * * * *